US005199329A

United States Patent [19]

Hsu

[11] Patent Number: 5,199,329

[45] Date of Patent: Apr. 6, 1993

[54] SOCKET WRENCH

[76] Inventor: Frank Hsu, No. 28, Chung-Hsing E. Rd., Tai-Ping Hsiang, Taichung Hsien, Taiwan

[21] Appl. No.: 961,802

[22] Filed: Oct. 16, 1992

[30] Foreign Application Priority Data

May 1, 1992 [TW] Taiwan ..... 79211345401

[51] Int. Cl.[5] ..... B25B 13/46

[52] U.S. Cl. ..... 81/59.1; 192/44

[58] Field of Search ..... 81/59.1, 60, 63.1; 192/45, 44

[56] References Cited

U.S. PATENT DOCUMENTS 3,771,632 11/1973 Kodousek et al. ..... 192/44

4,603,606 8/1986 Headen ..... 81/59.1

FOREIGN PATENT DOCUMENTS 136770 12/1902 Fed. Rep. of Germany ..... 81/59.1

*Primary Examiner*—D. S. Meislin

*Attorney, Agent, or Firm*—Shlesinger, Arkwright & Garvey

[57] ABSTRACT

A handle has a box end with an internal wall that confines a through-bore to receive movably a pair of identical rollers. The rollers has an eccentric shaft fixed between them and a central rectangular opening that extends through the eccentric shaft. An annular space formed around the eccentric shaft and confined by the internal wall of the box end includes a widest portion with a first length on one side of the eccentric shaft and a narrowest portion with a second length formed on the other side of the eccentric shaft. A plate is fixed perpendicularly between the rollers. A compression spring has one end secured to the plate. A cylindrical member with a diameter that is smaller than the first length but larger than the second length is disposed between the rollers. A second end of the compression spring connects securely the cylindrical member and biases the same such that the cylindrical member is located between the widest and narrowest portions wherein the cylindrical member frictionally abuts the internal wall of the box end and the eccentric shaft. The rollers are retained in the through-bore by a pair of retaining plates.

1 Claim, 2 Drawing Sheets

SOCKET WRENCH

BACKGROUND OF THE INVENTION

1. Field of Invention

This invention relates to a wrench, more particularly to one which uses a socket member for tightening or loosening a nut and which is simple in construction and economical to manufacture.

2. Description of the Related Art

Socket wrenches for turning nuts, bolts and similar fasteners have found wide acceptance throughout the mechanical arts. They generally permit such fasteners to be turned more easily and quickly and cause less wear to the fasteners themselves as compared to other types of wrenches such as adjustable wrenches, box wrenches and open-end wrenches.

Conventional socket wrenches generally require a compatible drive mechanism that engages the socket and affords the user a handle by which to apply torque to the socket. To permit the socket to be turned quickly in one direction, socket wrenches provide full torque in one direction and are substantially free-turning in the opposite direction.

The problem with the conventional socket wrench is that the drive mechanism is too delicate and complicated in construction which correspondingly increases production cost.

SUMMARY OF THE INVENTION

A main objective of the present invention is to provide a socket wrench which is simple in construction and economical to manufacture.

According to the present invention, the socket wrench includes a box end with an internal wall that confines a central bore to receive a pair of identical rollers which are fixedly connected by an eccentric shaft. The identical rollers each has a rectangular opening that extends through the eccentric shaft in which a drive shaft with two end portions is fittingly held. A pair of retaining plates each having a central hole passing therethrough, are provided at both sides of said box end to retain the identical roller therein with the two end portions of the drive shaft extending out through the central hole of the retaining plates. An annular space is formed around the eccentric shaft and is confined by the internal wall of the box end that includes a widest portion with a first predetermined length on one side of the eccentric shaft and a narrowest portion with a second predetermined length on the other side of the eccentric shaft opposite to the widest portion. A plate is disposed perpendicularly between the identical rollers. A cylindrical member that has a diameter smaller than the first predetermined length and larger than the second predetermined length is disposed between the identical rollers parallel to the eccentric shaft. A compression spring provided between the plate and the cylindrical member includes a first end fixed to the plate and a second end fixed to the cylindrical member. The compression spring biases the cylinder member into a position between the widest and the narrowest portion wherein the cylindrical member frictionally abuts against the internal wall of the box end and the eccentric shaft.

BRIEF DESCRIPTION OF THE DRAWINGS

Other features and advantages of the present invention will become apparent in the following detailed description, including drawings, all of which show a non-limiting form of the invention, and in which.

DETAILED DESCRIPTION OF THE PREFERRED EMBODIMENT

Figure 1:
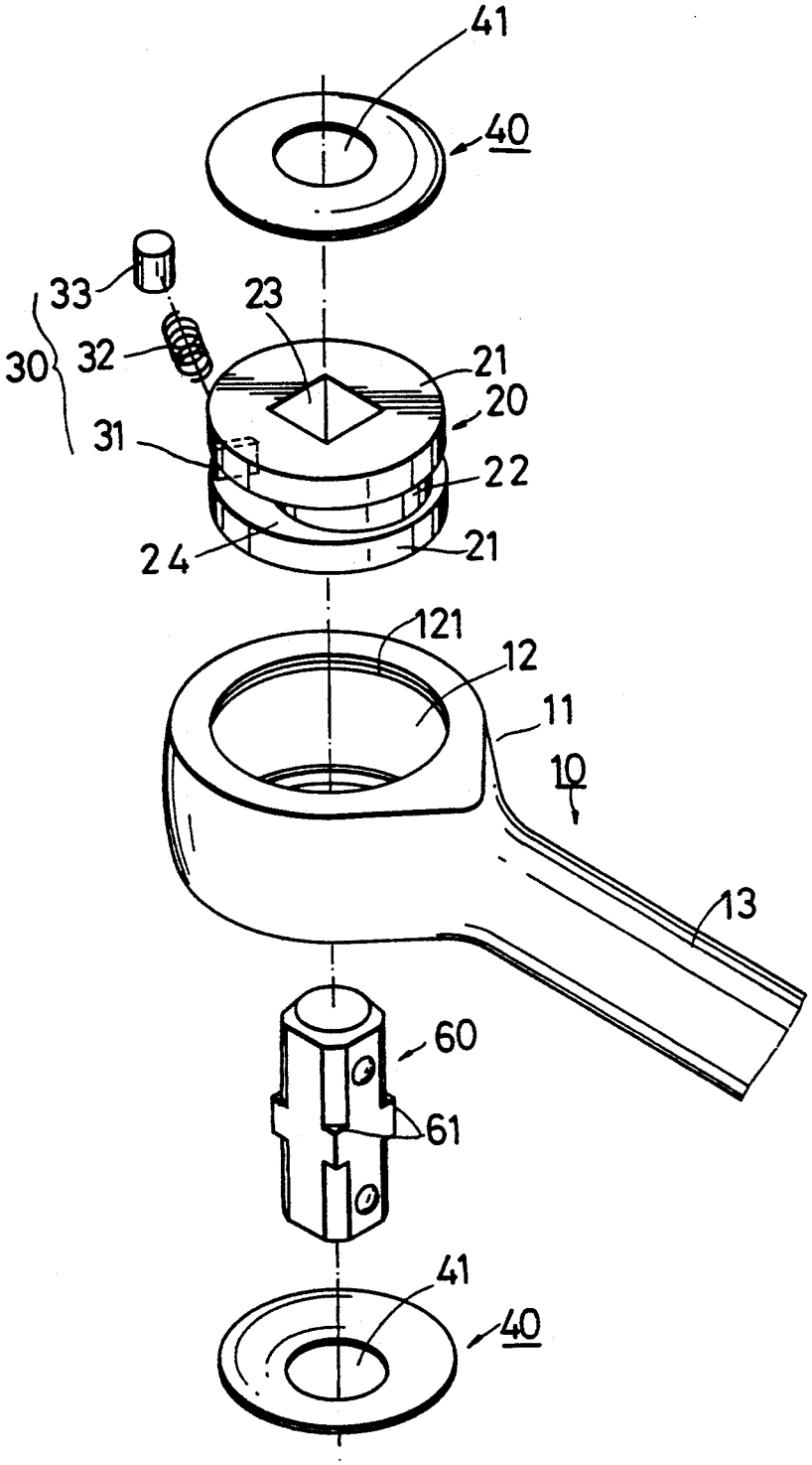
FIG. 1 is an exploded view of a socket wrench of the present invention.

Referring to FIG. 1, an exploded view of the socket wrench (10) of the present invention is shown to comprise a handle (13) that includes a box end (11) with an internal wall that confines a through-bore (12) therethrough. The internal wall of the box end (11) has a pair of recessed grooves (121) formed respectively adjacent to the periphery of the internal wall.

A pair of identical rolls (21) that have a diameter which is slightly smaller than that of the internal wall of the box end (11) is received in the through-bore (12). A shaft (22) rigidly and eccentrically connects the pair of identical rollers (21). Each of the identical rollers (21) includes a central rectangular opening (23) which extends through the eccentric shaft (22). An annular space formed around the eccentric shaft (22) and confined by the internal wall of the box end (11) includes a widest portion (27) with a first predetermined length on one side of the eccentric shaft (22) and a narrowest portion (26) with a second predetermined length on the other side of the eccentric shaft (22) opposite to the widest portion (27).

A drive shaft (60) that has a rectangular shoulder (61) at an intermediate portion is disposed and is fittingly held in the rectangular opening (23) of the identical rollers (21). A pair of arcuate retaining plates (40) respectively having a circular opening (41) that is smaller than the diagonal length of the rectangular opening (23) of the identical roller (21) are provided by high compressing means or any suitable means on both sides of the box end (11) such that the identical rollers (21) are retained in the box end (11). Under this condition, two end portions of the drive shaft (60) protrude out from the opening (41) of the retaining plate (40). A socket member (not shown) can be attached to the end portions of the drive shaft (60) for turning or loosening a fastener thereon.

A plate member (31) is securely and perpendicularly disposed between the identical rollers (21). A cylindrical member (33) that has a diameter smaller 10 than the first predetermined length but larger than the second predetermined length is movably disposed between the identical rollers (21).

A compression spring (32) is disposed between the identical rollers parallel to the eccentric shaft (22) and between the cylindrical member (33) and the plate member (31). The compression spring (32) includes a first end fixedly attached to the plate member (31) and a second end securely connected to the cylindrical member (33). The compression spring (32) biases so as to locate the cylindrical member (33) at a position between the widest and the narrowest portions (26, 27). Under this condition, the cylindrical member (33) frictionally abuts the internal wall of the box end (II) and the eccentric shaft (22).

Figure 3:
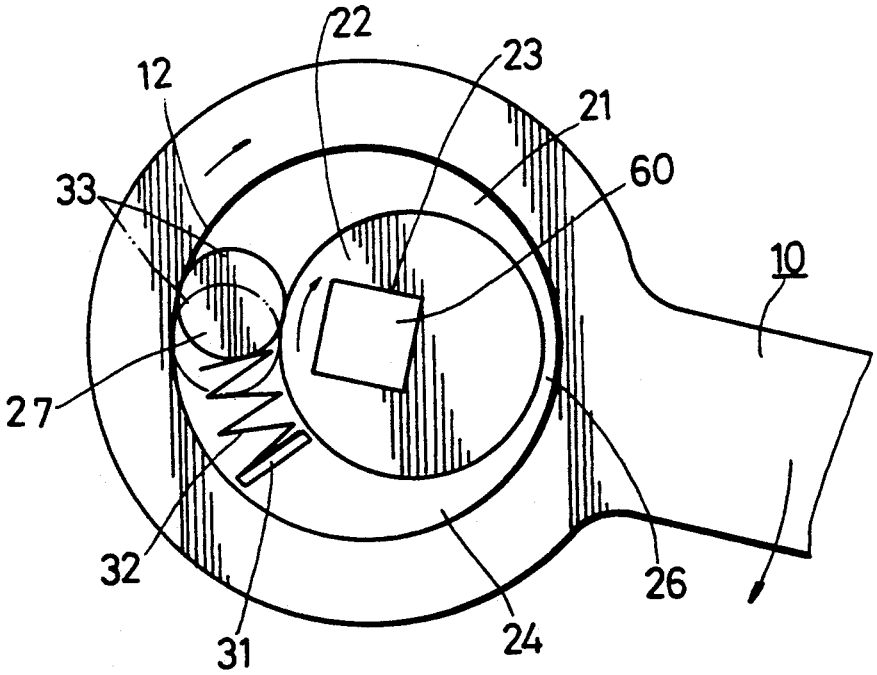
FIG. 3 shows the socket wrench of the present invention in use, illustrating the socket wrench turning a work piece.

Referring to FIG. 3, when the handle (10) is rotated in a clockwise direction, the cylindrical member (33) is moved to a position as shown by solid line from the position shown in dotted line, wherein the cylindrical member (33) is further engaged frictionally between the internal wall of the box end (11) and the eccentric shaft (22). Thus the eccentric shaft (22) rotates together with the box end (11) and correspondingly drives the drive shaft (60).

Figure 2:
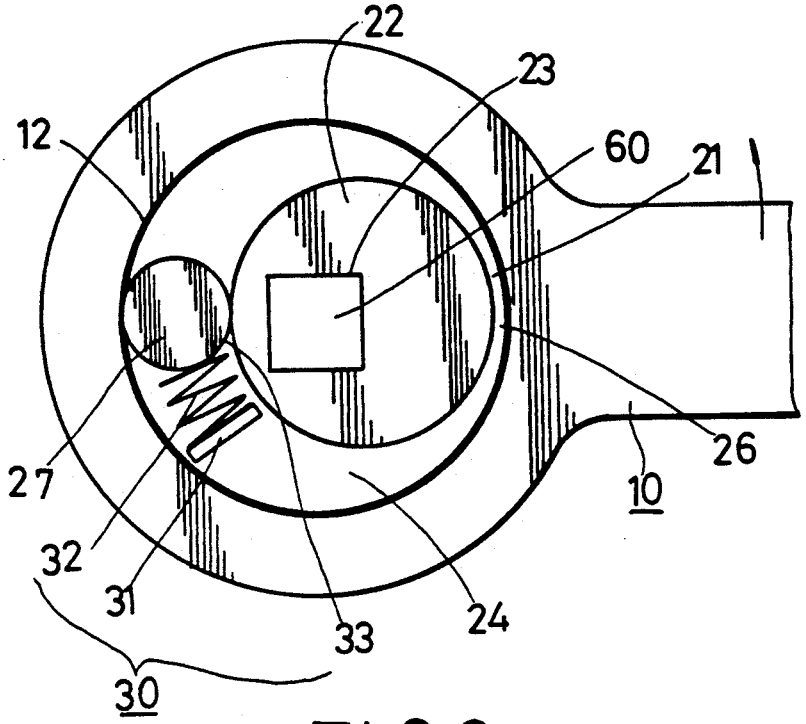
FIG. 2 shows the socket wrench of the present invention, in an idle rotation.

Referring to FIG. 2, when the handle (10) is rotated in a counter clockwise direction, the cylindrical member (33) moves against the biasing action of the compression spring (32) to the widest portion (27), at which the cylindrical member (33) disengages the internal wall of the box end (11) and the eccentric shaft (22). Thus, the handle (10) idly rotates relative to the identical rollers (21).

As illustrated and explained, it can be seen that the drive shaft and the engaging mechanism employed in the socket wrench of the present invention is simple in construction and therefore is easy to produce and correspondingly cheap in cost.

While a preferred embodiment of the invention has presently been shown and described, it is to be understood that the invention is not limited thereto and that various modifications are possible without departing from the scope and spirit of the present invention. It is therefore intended that the present invention be only limited as define in the appended claims.

I claim:

1. A wrench used with a socket member, said wrench comprising:

a handle having a box end with an internal wall that confines a central bore through said box end;

a pair of identical rollers having a diameter smaller than that of said internal wall and being disposed in said central bore of said box end, said pair of identical rollers having an eccentric shaft fixed therebetween, said eccentric shaft having a central rectangular opening passing therethrough and an annular space being formed around said eccentric shaft between said pair of identical rollers and being confined by said internal wall, said annular space having a widest portion with a first predetermined length formed on one side of said eccentric shaft and a narrowest portion with a second predetermined length formed on the other side of said eccentric shaft opposite to said widest portion thereof;

a pair of retaining plates mounted to said box end on both sides of said pair of identical rollers respectively so as to retain said pair of rollers in said box end, each of said retaining plates having a circular hole formed therethrough and aligned with said central rectangular opening of said pair of identical rollers, said circular hole having a diameter which is smaller than diagonal length of said central rectangular opening of said pair of identical rollers;

a drive shaft disposed in said central rectangular openings of said pair of identical rollers and provided with two end portions which respectively protrude out of said circular holes of said retaining plates such that said end portions can be inserted in said socket member to rotate a nut, said drive shaft having a rectangular shoulder formed at an intermediate portion thereof and being fittingly held in said rectangular opening so as to permit rotation of said drive shaft with said rollers, said drive shaft being prevented by said retaining plates from falling out of said rectangular opening of said pair of identical rollers;

a plate member fixed between said narrowest and widest portion confined by said pair of identical rollers and said internal wall of said box end, said plate member being perpendicular to two opposed inner faces of said identical rollers;

a compression spring including a first end fixed to said plate member and a second end;

a cylindrical member disposed movably between said pair of identical rollers and having an axis parallel to said eccentric shaft, said cylindrical member further having a diameter which is smaller than said first predetermined length but is larger than said second predetermined length, said second end of said compression spring being connected to and biasing said cylindrical member so as to locate said cylindrical member at a position between said widest and narrowest portions, wherein said cylindrical member frictionally abuts against said internal wall of said box end and said eccentric shaft;

whereby when said handle is rotated in a first direction, said cylindrical member moves from said position towards said narrowest portion thereby correspondingly rotating said eccentric shaft in said first direction; and whereby when said handle is rotated in a second direction opposite to said first direction, said cylindrical member moves towards said widest portion against biasing action of said compression spring, wherein said cylindrical member disengages with said internal wall of said box end and said eccentric shaft so that said handle rotates idly relative to said identical rollers.

* * * * *